US009404714B2

(12) United States Patent
Langevin et al.

(10) Patent No.: US 9,404,714 B2
(45) Date of Patent: Aug. 2, 2016

(54) MODULAR RAIL SYSTEM AND FIREARM WITH MODULAR RAIL SYSTEM

(75) Inventors: Kevin Richard Langevin, Berlin, CT (US); David Michael Camera, Meriden, CT (US); Michael Andrew Josey, Farmington, CT (US)

(73) Assignee: COLT'S MANUFACTURING IP HOLDING COMPANY LLC, West Hartford, CT (US)

( * ) Notice: Subject to any disclaimer, the term of this patent is extended or adjusted under 35 U.S.C. 154(b) by 231 days.

(21) Appl. No.: 13/462,346

(22) Filed: May 2, 2012

(65) Prior Publication Data

US 2012/0297970 A1 Nov. 29, 2012

Related U.S. Application Data

(60) Provisional application No. 61/481,697, filed on May 2, 2011.

(51) Int. Cl.

| | |
|---|---|
| ***F41A 3/00*** | (2006.01) |
| ***F41G 11/00*** | (2006.01) |
| ***F41A 3/66*** | (2006.01) |
| ***F41C 23/16*** | (2006.01) |

(52) U.S. Cl.
CPC ..... *F41G 11/003* (2013.01); *F41A 3/66* (2013.01); *F41C 23/16* (2013.01)

(58) Field of Classification Search
CPC ..... F41G 11/003; F41A 3/66; F41C 23/16
USPC ..... 89/125; 42/71.01, 72, 90
See application file for complete search history.

(56) References Cited

U.S. PATENT DOCUMENTS

| | | | | |
|---|---|---|---|---|
| 4,536,982 | A * | 8/1985 | Bredbury et al. | 42/71.01 |
| 4,663,875 | A * | 5/1987 | Tatro | 42/71.01 |
| 6,490,822 | B1 | 12/2002 | Swan | |
| 6,609,321 | B2 * | 8/2003 | Faifer | 42/71.01 |
| 6,694,660 | B1 * | 2/2004 | Davies | 42/75.01 |
| 6,779,288 | B1 * | 8/2004 | Kim | 42/72 |
| 6,792,711 | B2 | 9/2004 | Battaglia | |
| 7,131,228 | B2 | 11/2006 | Hochstrate et al. | |
| 7,305,789 | B2 * | 12/2007 | Frost | 42/125 |
| 7,458,179 | B2 * | 12/2008 | Swan | F41G 11/003 42/105 |
| 7,775,150 | B2 | 8/2010 | Hochstrate et al. | |
| 7,891,130 | B2 | 2/2011 | Griffin | |
| 7,971,383 | B2 * | 7/2011 | Fitzpatrick et al. | 42/96 |
| 8,141,285 | B2 * | 3/2012 | Brown | 42/71.01 |
| 8,201,353 | B1 * | 6/2012 | Swan | 42/71.01 |
| 8,316,574 | B1 * | 11/2012 | Swan | 42/146 |

(Continued)

OTHER PUBLICATIONS

International Search Report dated Jan. 25, 2013 for International Application No. PCT/US2012/036117.

(Continued)

*Primary Examiner* — Michelle R Clement
(74) *Attorney, Agent, or Firm* — Cantor Colburn LLP

(57) ABSTRACT

An upper receiver for a weapon, the upper receiver having a plurality channels each being oriented in a first direction and wherein each of the plurality of channels intersect an elongated channel extending in a second direction; a modular rail having a pair of securement features configured to be slidably received within a pair of the plurality of channels such that modular rail can slide in the pair of the plurality of channels in the first direction until the pair of features can slide within the elongated channel in the second direction.

18 Claims, 17 Drawing Sheets

(56) References Cited

U.S. PATENT DOCUMENTS

| | | | | |
|---|---|---|---|---|
| D676,920 | S * | 2/2013 | Fitzpatrick et al. | D22/108 |
| 8,429,845 | B1 * | 4/2013 | Swan | 42/90 |
| 8,505,433 | B2 * | 8/2013 | Hochstrate et al. | 89/193 |
| 8,561,335 | B2 * | 10/2013 | Brown | 42/71.01 |
| 8,640,372 | B2 * | 2/2014 | Hochstrate et al. | 42/75.01 |
| 2003/0074822 | A1 * | 4/2003 | Faifer | 42/71.01 |
| 2006/0260169 | A1 * | 11/2006 | Samson et al. | 42/72 |
| 2009/0193702 | A1 * | 8/2009 | Lin | 42/72 |
| 2010/0095575 | A1 * | 4/2010 | Swan | 42/72 |
| 2010/0175293 | A1 * | 7/2010 | Hines | 42/71.01 |
| 2010/0192443 | A1 | 8/2010 | Cabahug et al. | |
| 2010/0269392 | A1 * | 10/2010 | Swan | 42/71.01 |
| 2011/0192066 | A1 * | 8/2011 | Kimmel et al. | 42/71.01 |
| 2012/0152104 | A1 * | 6/2012 | Audibert et al. | 89/191.01 |

OTHER PUBLICATIONS

Written Opinion dated Jan. 25, 2013 for International Application No. PCT/US2012/036117.

Supplementary European Search Report dated Sep. 26, 2014 for Application No. PCT/US2012036117.

* cited by examiner

MODULAR RAIL SYSTEM AND FIREARM WITH MODULAR RAIL SYSTEM

CROSS REFERENCE TO RELATED APPLICATIONS

This application claims the benefit of U.S. Provisional Patent Application No. 61/481,697 filed May 2, 2011, the contents of which are incorporated herein by reference thereto.

BACKGROUND

Embodiments of the invention relate generally to an apparatus and method for mounting items on a firearm.

Numerous accessories are mounted on a standard firearm rail by engaging features of the rail non-limiting examples of such features include but are not limited to telescopic sights, tactical sights, laser sighting modules, Global Positioning Systems (GPS) and night vision scopes. Standard firearm rails include a military standard 1913 rail, Weaver rail, NATO STANAG 4694 accessory rail or equivalents thereof.

Accordingly, it is desirable to provide a method and apparatus for mounting accessories to a rail of a firearm.

SUMMARY OF THE INVENTION

In one exemplary embodiment an upper receiver for a weapon is disclosed, the upper receiver having a plurality channels each being oriented in a first direction and wherein each of the plurality of channels intersect an elongated channel extending in a second direction; a modular rail having a pair of securement features configured to be slidably received within a pair of the plurality of channels such that modular rail can slide in the pair of the plurality of channels in the first direction until the pair of features can slide within the elongated channel in the second direction.

In another embodiment, an upper receiver for a weapon is provided, the upper receiver having: a plurality channels each being oriented in a first direction on opposite exterior sides of the upper received and wherein each of the plurality of channels intersect an elongated channel extending in a second direction; a plurality of modular rails each having a pair of securement features configured to be slidably received within a pair of the plurality of channels such that each of the plurality of modular rails can slid in the pair of the plurality of channels in the first direction until the pair of features can slide within the elongated channel in the second direction.

Other aspects and features of embodiments of the invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Reference is made to the following U.S. Pat. Nos. 6,792,711; 7,131,228; and 7,775,150 the contents each of which are incorporated herein by reference thereto.

Disclosed herein is an apparatus, method and system for providing a modular rail for a weapon or firearm to provide various options for mounting accessories such as: telescopic sights, tactical sights, laser sighting modules, illumination devices, and vision enhancing devices, Global Positioning Systems (GPS), night vision scopes and grenade launchers to the weapon. This list is not meant to be exclusive, merely an example of accessories that may utilize a modular rail. An accessory is illustrated schematically by box 1 in FIG. 2. The accessories are removably mounted to the rails in a manner known to those skilled in the related arts by for example, engaging the features of the "Piccatiny Rail" configuration as described in Military Standard 1913 (MIL-STD-1913 (AR).

Figure 1:
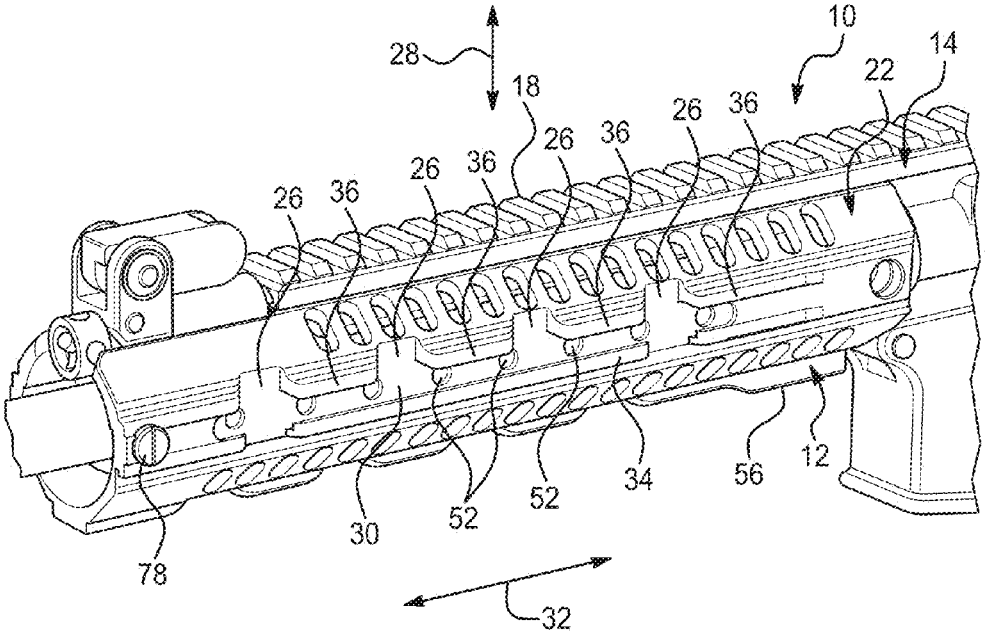
FIG. 1 is a left side perspective view of a modular rail system in accordance with an exemplary embodiment of the present invention.

Referring now to FIG. 1, a perspective view of a modular rail or modular rail system 10 of a firearm is provided. Illustrated in the attached FIGS. is a hand guard 12 of an upper receiver 14. In accordance with an exemplary embodiment of the present invention the hand guard and the upper receiver may be an integral one piece member of unitary construction. In addition and as discussed below, the upper receiver may have a removable bottom portion or bottom hand guard portion.

Hand guard 12 or a portion of the upper receiver 14 is configured with at least one integral rail such as a "Piccatiny Rail" configuration as described in Military Standard 1913 (MIL-STD-1913 (AR)), which is hereby incorporated by reference herein in its entirety. Other rails will be removably secured to the upper receiver to provide numerous mounting configurations. Of course, other rail configurations are configured to be within the scope of various embodiments of the present invention. The hand guard and rails may be made from any suitable material such as hard coat anodized aluminum as an example.

As illustrated, in the attached FIGS. the hand guard 12 is provided with an integral upper rail portion 18 and a plurality of modular rail portions 20. In one embodiment, the modular rail portions 20 can have varying lengths or sizes to provide numerous configurations and/or variations. The hand guard or upper receiver is configured to have a plurality of integral features for removably receiving and engaging the modular rail portions 20 such that user desired configurations can be provided.

Integrally formed on the left side and right side (e.g., nine o'clock and three o'clock positions) of the hand guard of the upper receiver are a plurality of features 22. Features 22 are configured to releasably receive appropriately shaped features 24 of the modular rail portions 20. As illustrated in the attached FIGS., a plurality of channel openings 26 are provided wherein each of the plurality of channel openings 26 is configured to allow the features 24 of the modular rail portion 20 to be inserted into and out of channel openings 26 in a vertical direction illustrated by arrows 28. As illustrated, each of the plurality of channel openings 26 are configured to be appropriately distanced apart from each other such that the distance between each of the channel openings corresponds to the distance between each of the features 24 of the modular rail portion 20. Accordingly, a modular rail portion 20 can be inserted into features 22 such that features 24 are now slidably received within a horizontally disposed channel 30 wherein the modular rail portion 20 is now capable of moving horizontally in the directions illustrated by arrows 32.

In one non-limiting configuration, channel openings 26 are disposed at either end of horizontal channel 30 pass completely through channel 30 as opposed to the channels 26 located in the middle of the features 22.

Features 24 are configured to be slidably received within channel openings 26 during vertical movement of the modular rail when features 24 are received within the channel openings 26. Once the features are received within the horizontally disposed channel 30, the modular rail portion 20 is retained to the hand guard or upper receiver by a lower ledge portion 34 and upper ledge portions 36, each of which has a flange portion that will be received between feature 24 and a surface 38 of the modular rail portion.

Figure 3A:
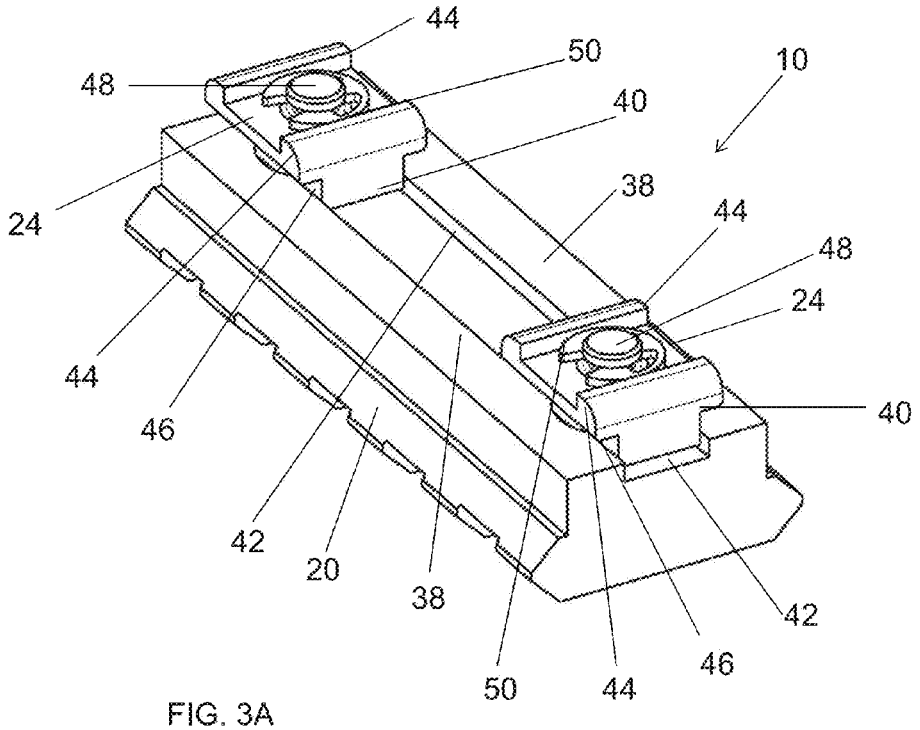
FIGS. 3A-3C are perspective views of a rail configured for use with the modular rail system.
Figure 3B:
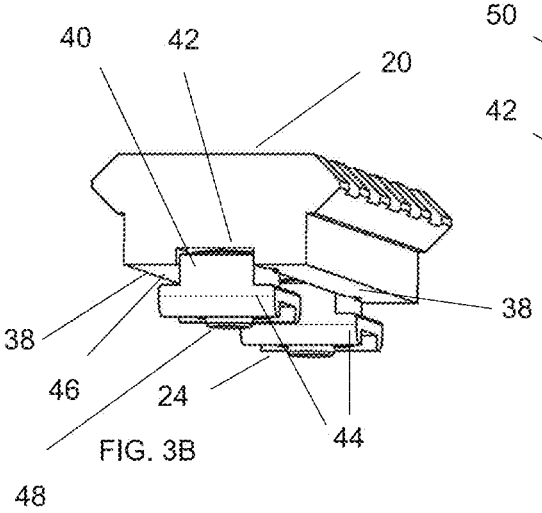
Figure 3C:
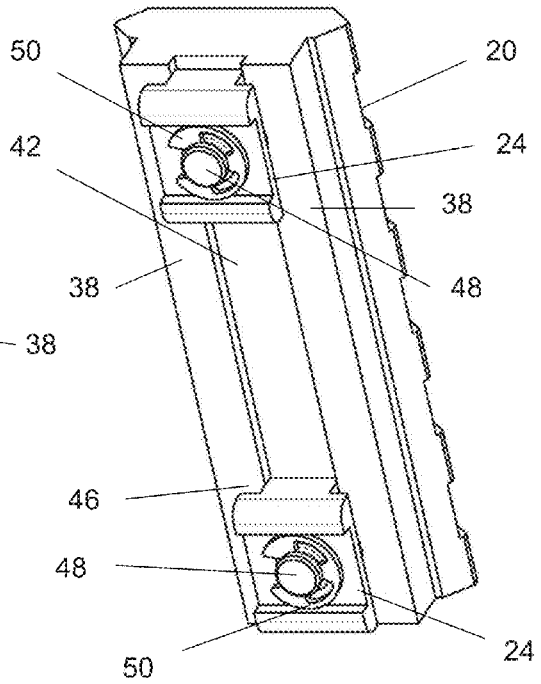

As illustrated in at least FIGS. 3A-3C, features 24 have a portion 40 received within a channel 42 of the modular rail portion 20. Ear members 44 extend away from portion 40 and are configured to be in a facing spaced relationship with respect to surface 38 such that a gap 46 is provided between ear member 44 and surface 38. Each of the features 24 are secured to the modular rail portion 20 via a screw or other equivalent member 48, which in one non-limiting embodiment has a pin or feature 50 secured to a distal end of the screw so that the same cannot be completely withdrawn from the modular rail portion and thus disengaging feature 24 from channel 42.

In accordance with one non-limiting embodiment, the screw or other equivalent device threadingly engages a threaded opening of the feature such that the location of ear members 44 can be varied in order to insert the modular rail portion into channel 30, slide the same horizontally wherein the flange of the lower ledge portion 34 and the flange of at least one upper ledge portion 36 slides in the gap 46 between ear members 44 and surface 38. Thereafter, the screw 48 is tightened by rotating it in the threaded opening of rail portion 20 to secure the flanges between the surface 38 and ear members 44 by drawing the same towards surface 38 when the screw is tightened. Thus and when the modular rail 20 is secured in place a portion of the flange of the lower ledge and at least one upper ledge is clamped between the ear members 44 and the surface 38. This allows a user or operator to adjustably mount the modular rail portion 20 and a variety of locations on the hand guard or upper receiver.

In addition, a plurality of apertures or openings 52 are provided to receive a distal end of the screw proximate to the pin or feature 50. In one non-limiting embodiment, these openings 52 are provided as locating features for the modular rail 20 as it is slid within channel 30. Once the modular rail 20 is in the desired location the screws 48 are tightened such that the flange of the lower ledge portion 34 and the flange of at least one upper ledge portion is secured between the ears 44 and the surface 38 of the modular rail. Accordingly and in this embodiment openings 52 are aligned with the positioning of screws 48 in rail 20.

Figure 15:
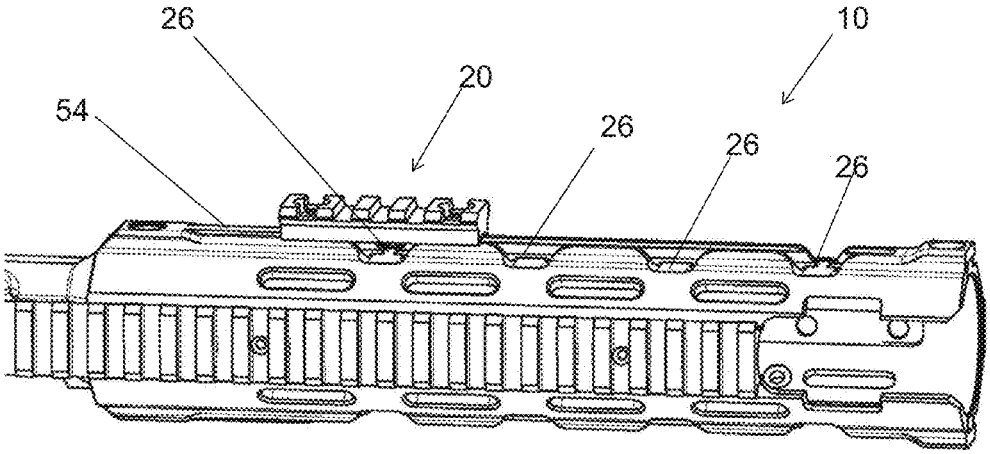
FIG. 15-18 are views of a portion of an upper receiver with a removable rail member secured thereto.
Figure 16:
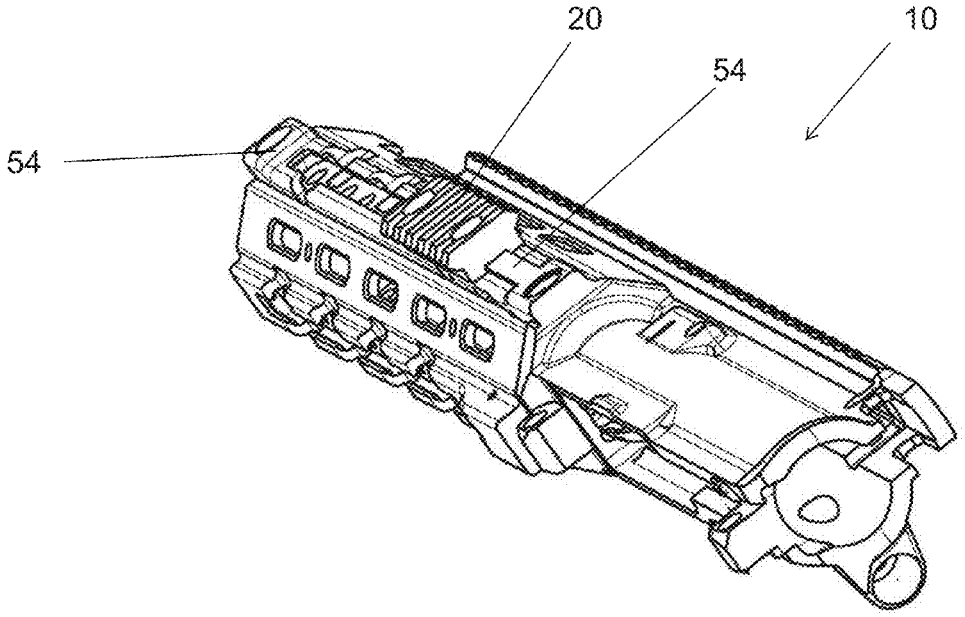
Figure 17:
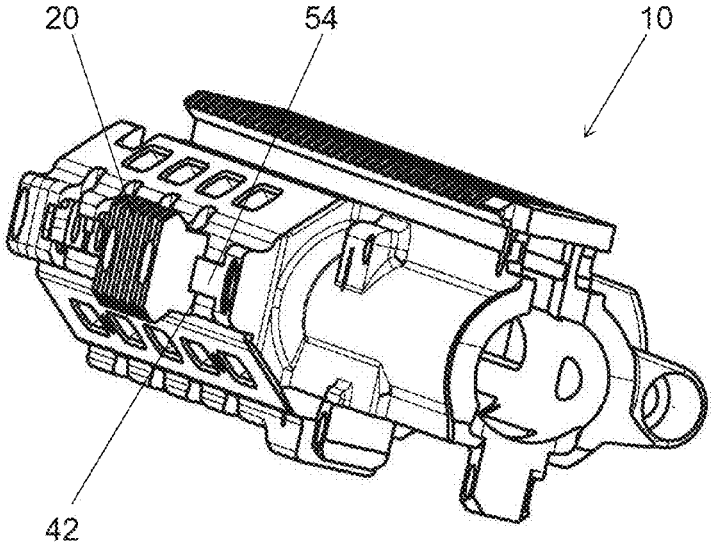
Figure 18:
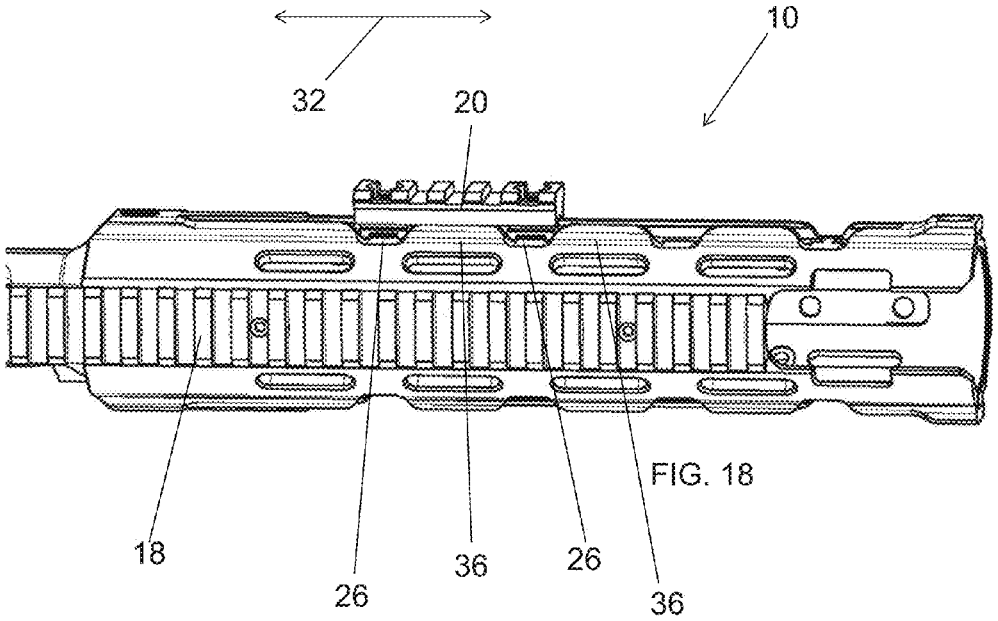

In addition and referring now to at least FIGS. 15 and 16 and in one non-limiting alternative exemplary embodiment, the surface of the hand guard integrally formed with the upper receiver has a pair of longitudinally disposed features 54 located at either and of channel 30. Features 54 provide a raised profile configured to slidably engage channel 42 of modular rail 20 when it is located at either end of channel 30. Here a portion of the modular rail 20 may extend past channel 30 however the raised profile of feature 54 provides support and engagement to modular rail 20 when it is secured at either end of channel 30.

Figure 2:
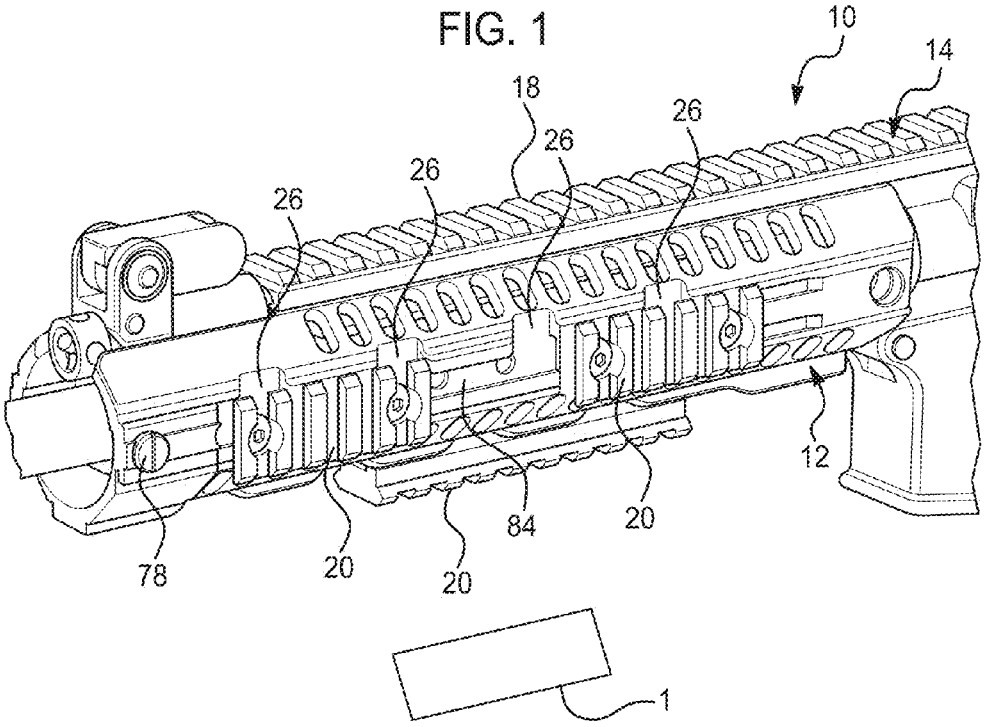
FIG. 2 is a left side perspective view of a modular rail system in accordance with an exemplary embodiment of the present invention with a plurality of rails secured thereto.
Figure 4:
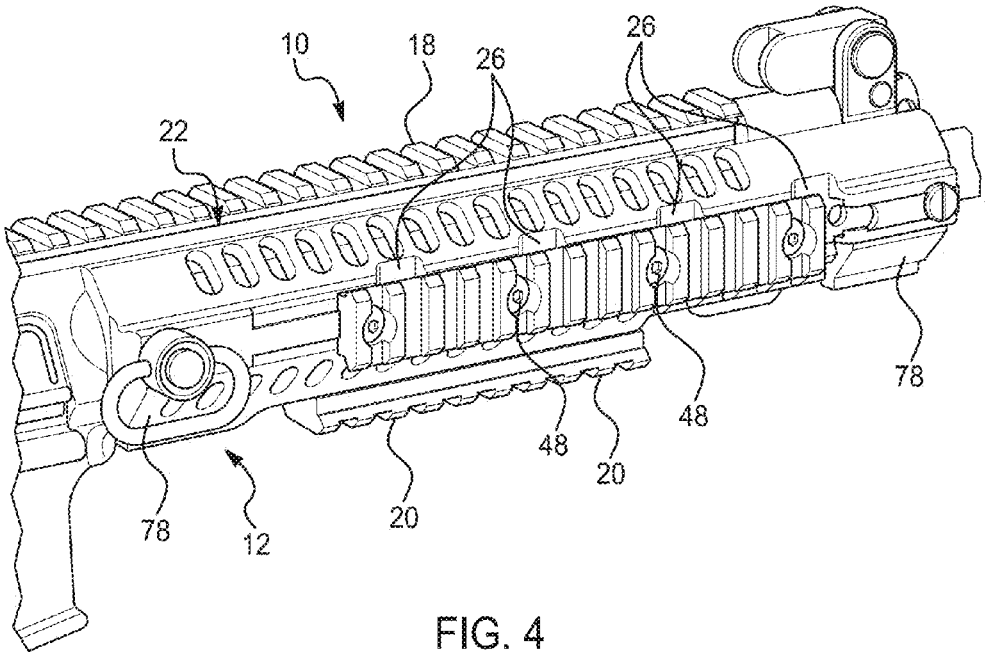
FIG. 4 is a right side perspective view of the modular rail system without modular rails secured thereto.
Figure 5:
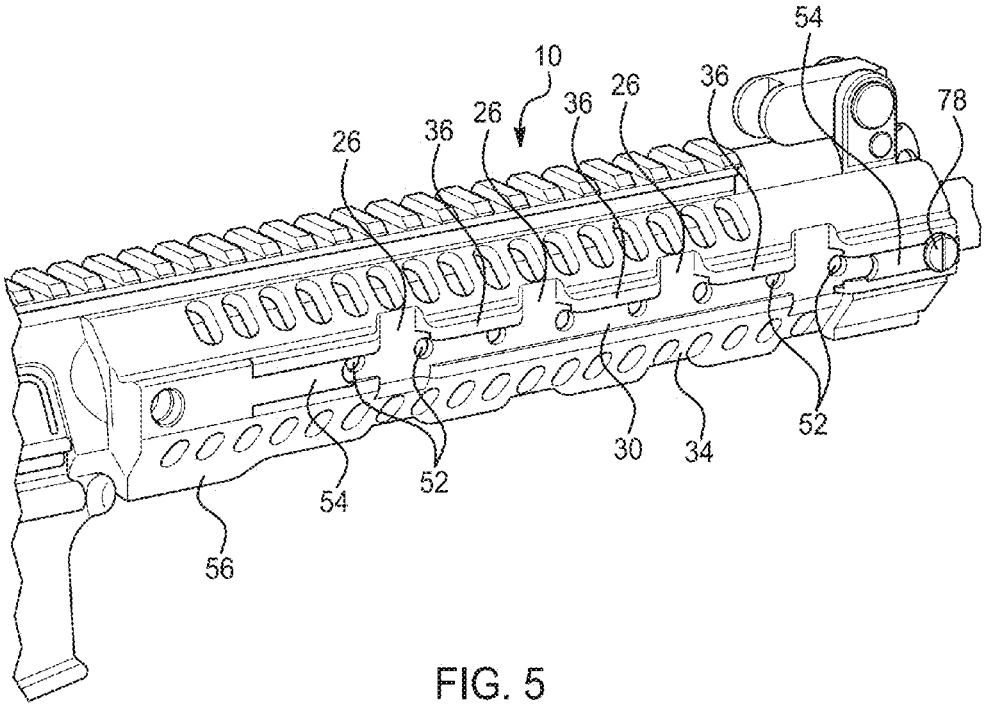
FIG. 5 is a right side perspective view of the modular rail system with modular rails secured thereto.
Figure 6:
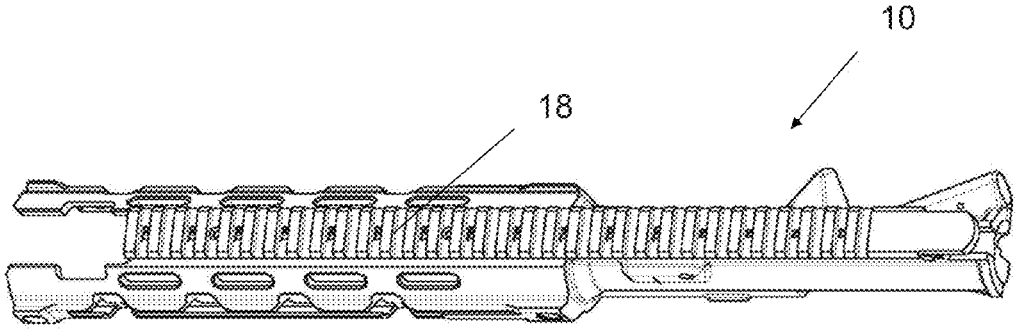
FIG. 6 is a top view of a portion of an upper receiver configured for use as a modular rail system.
Figure 7:
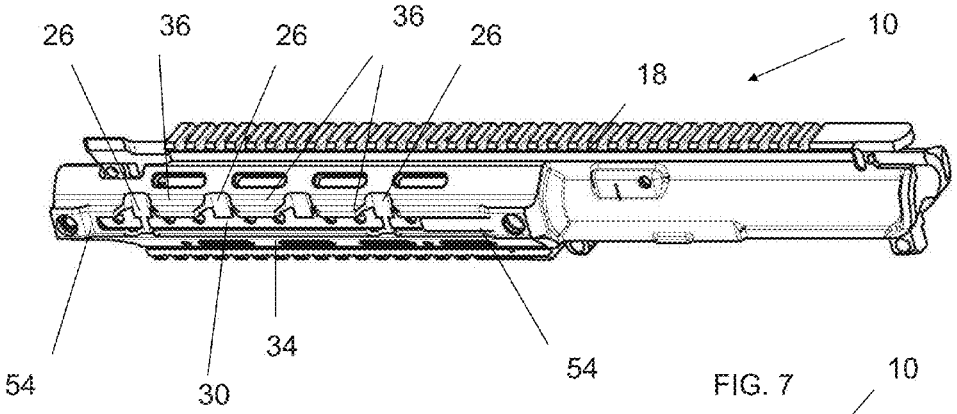
FIGS. 7 and 8 are side perspective views of the upper receiver illustrated in FIG. 6.
Figure 8:
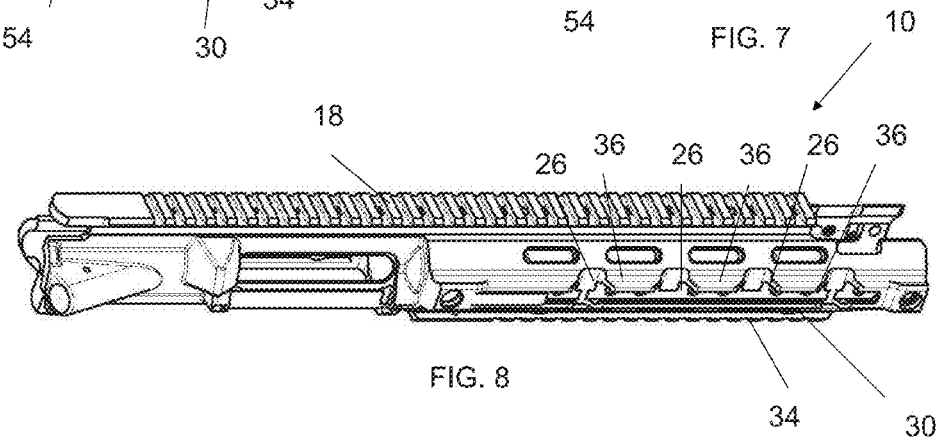
Figure 9:
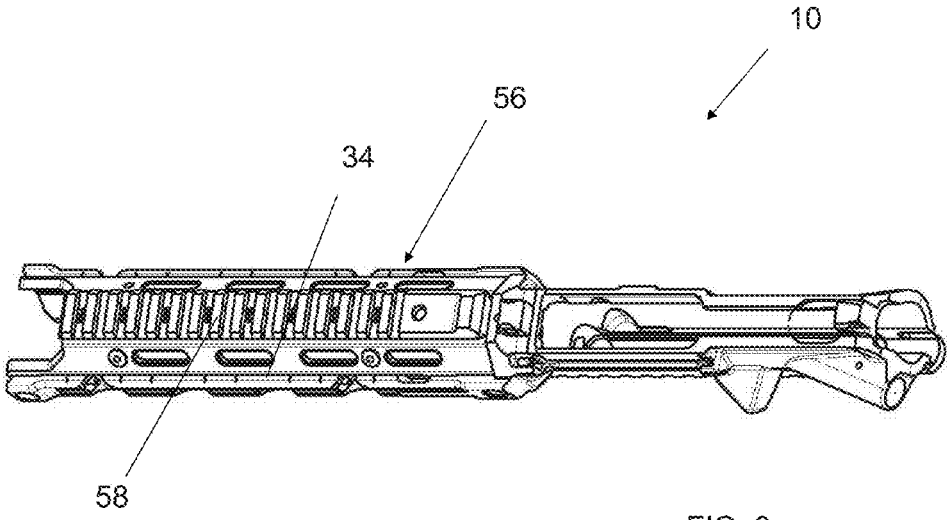
FIG. 9 is a bottom perspective view of the upper receiver illustrated in FIG. 6.
Figure 10:
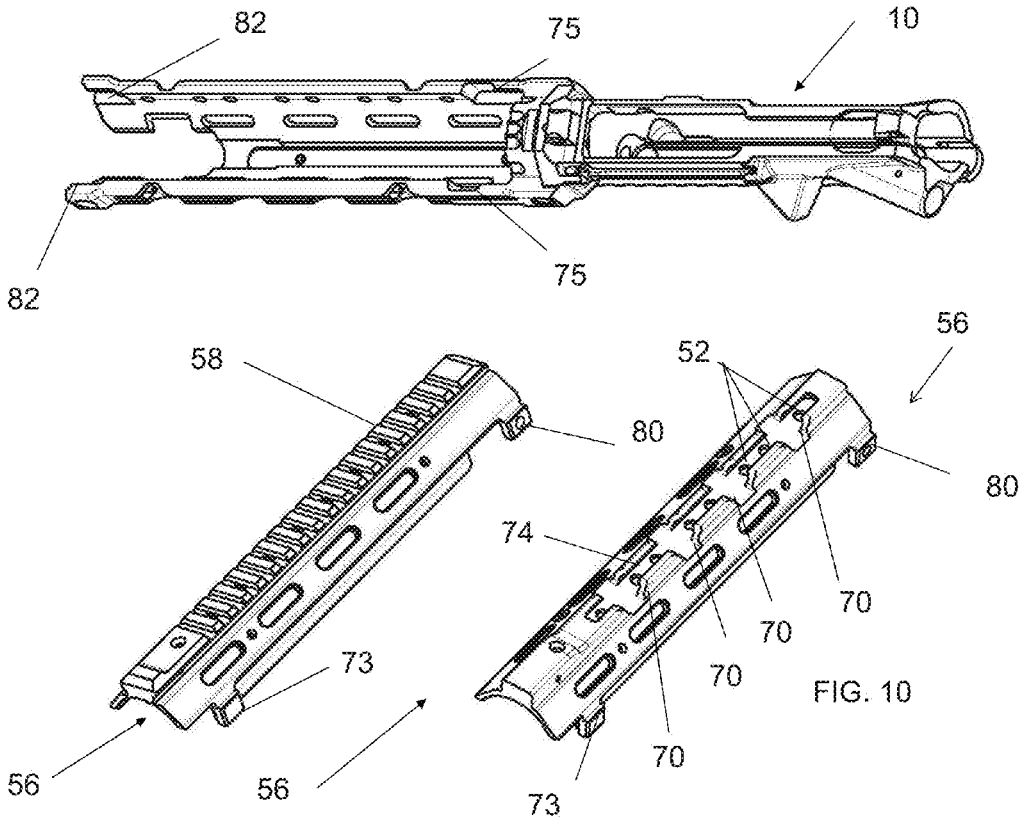
FIGS. 10 and 11 are perspective views of the upper receiver illustrating two alternative bottom portions.
Figure 11:
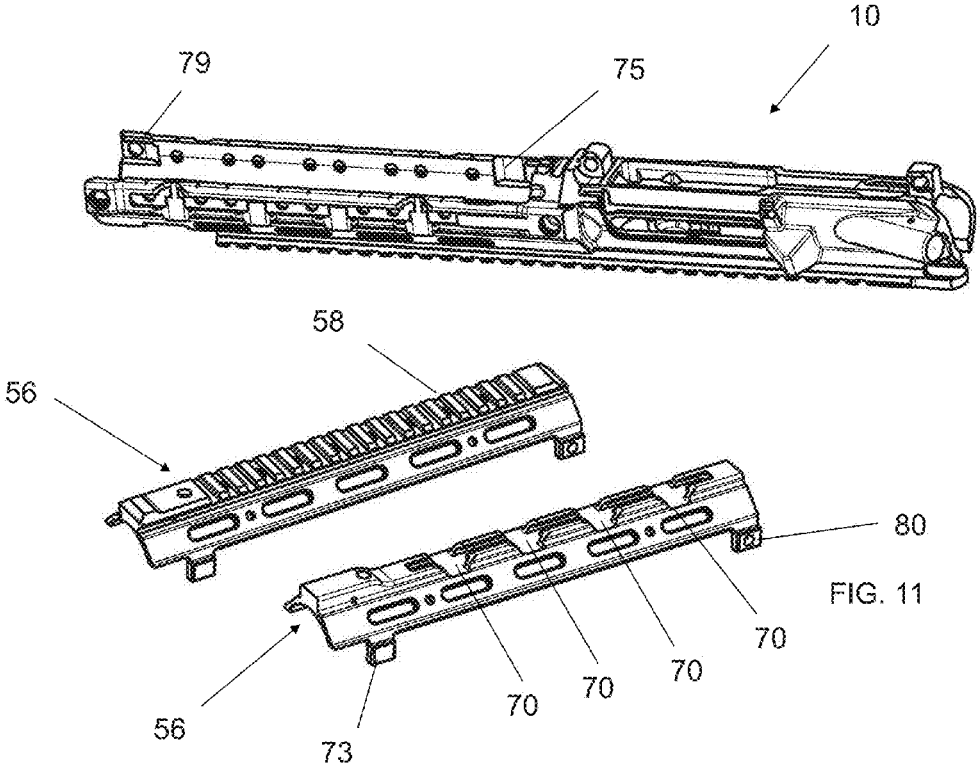
Figure 12:
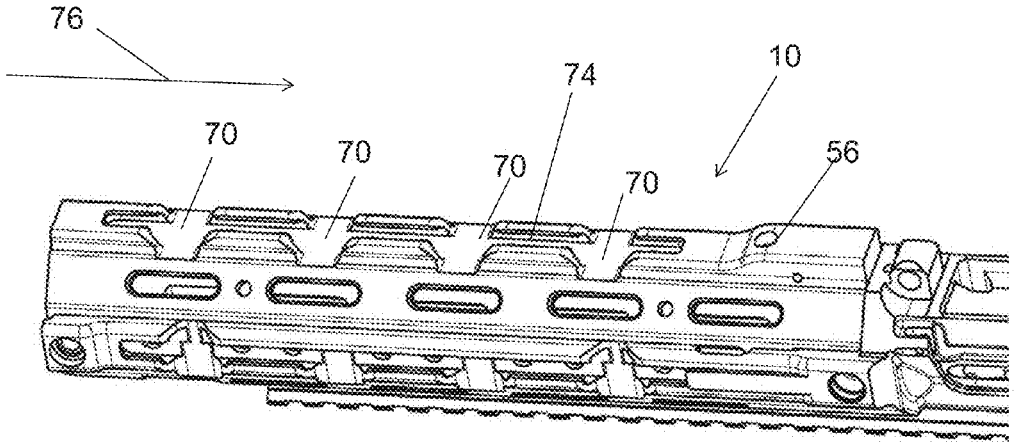
FIGS. 12-14 are views illustrating a portion of an upper receiver configured for use with the modular rail system.
Figure 13:
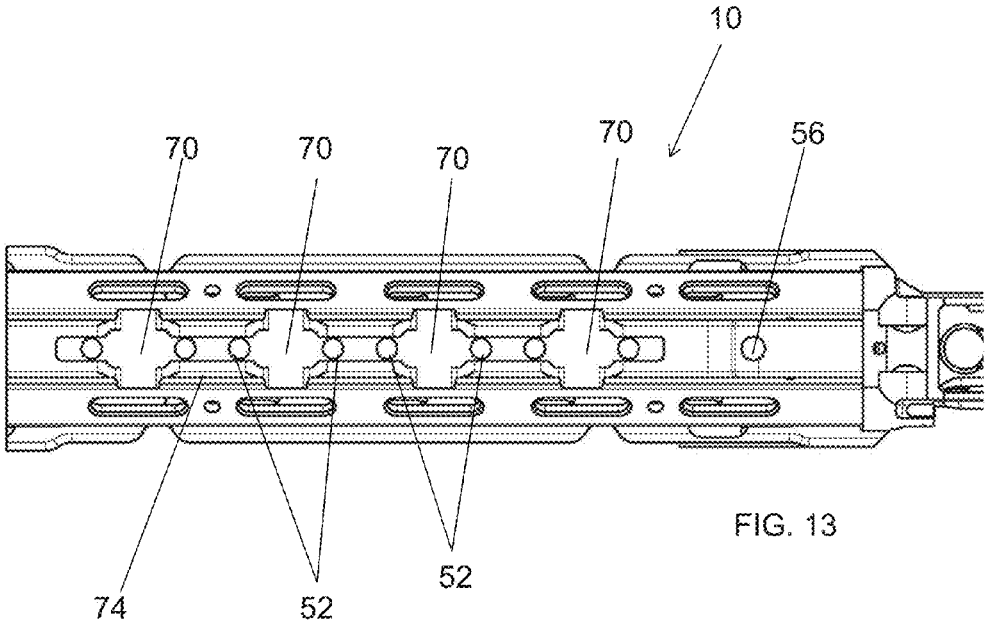
Figure 14:
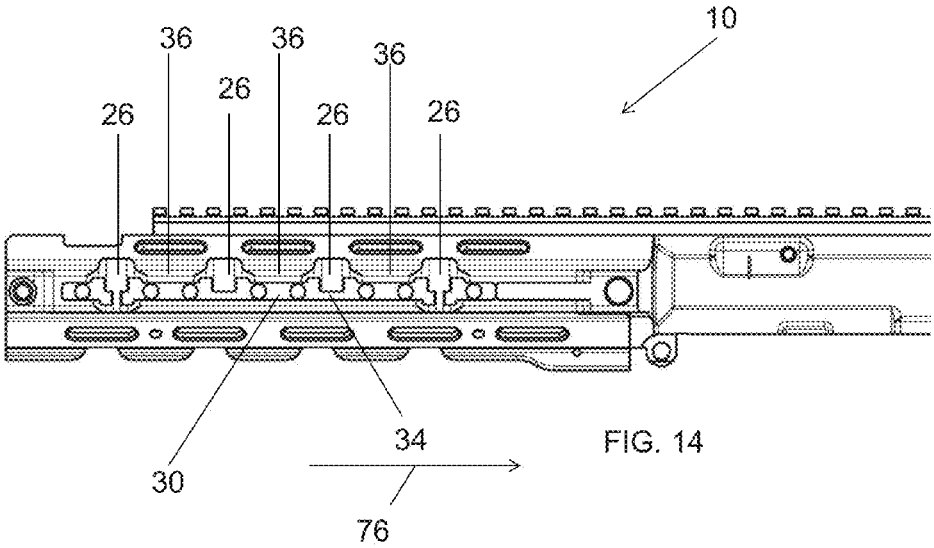

As illustrated in the FIGS., modular rail 20 can have varying lengths such that discreetly located modular rails can be positioned and repositioned on the hand guard for example at the nine o'clock position illustrated in FIG. 2. Alternatively, a larger or longer modular rail can be provided for example, the modular rail 20 secured at the six o'clock position illustrated in FIG. 2. FIG. 4 also shows modular rails of varying lengths. The number of features 24 associated with the modular rail will depend on the length of the modular rail. For example, the modular rails secured to the nine o'clock position of the hand guard in FIG. 2 each have a pair of features 24 while the modular rail secured to the three clock position of the hang guard in FIG. 4 has four features 24.

Referring now to at least FIG. 10-14, the hand guard/upper receiver has a removable bottom portion 56. In one embodiment, the removable bottom portion 56 has an integral lower 6 o'clock rail 58 for different mounting options, such a grenade launcher. One non-limiting example of such a grenade launcher is found in U.S. Pat. No. 7,360,478 the contents of which are incorporated herein by reference thereto.

In another embodiment, the removable bottom portion is configured to have a plurality of channels 70 which intersect a longitudinally disposed channel 74 wherein modular rails 20 can be secured thereto similar to the configurations provided for in the three and nine o'clock positions. However, and since this is configured for six o'clock mounting positions channels 70 extend completely through channel 74 such that features 24 of a modular rail 20 can be inserted therein from either side of the removable bottom portion. This is in contrast to the elongated ledge 34 which is configured to provide vertical support to the modular rail at the three and nine o'clock positions. This support is desirable since components mounted to the modular rail 20 at the three and nine o'clock positions may have a mass that requires additional support from ledge portion 34 as opposed to a mass secured at the six o'clock position. As used herein, the three, six, nine and twelve o'clock positions correspond with the longitudinal axis of the firearm, rifle or weapon. In other words, the three and nine o'clock positions correspond to left and right while six and twelve o'clock positions correspond to top and bottom.

In one non-limiting embodiment, the removable bottom portion uses a keyed/key way system or tongue and groove system. Here, the removable bottom portion 56 has a pair of tabs 73 which are inserted into complementary openings 75 of the upper receiver/hand guard and the bottom portion is slid in the direction of arrow 76 until the bottom portion 70 is in its desired location and the same is secured to the upper receiver via fastening means 78 inserted into complementary openings in both the upper receiver and the bottom portion 70. In addition and while the bottom portion is slid in the direction of arrow 76 another pair of tabs 80 are received within complementary openings 82. Similarly, fastening means 78 are also inserted in the complementary openings of tabs 80 and openings 82.

In order to remove bottom portion 70, user simply removed the fastening means 78 and slides the bottom portion 70 in a direction opposite to arrow 76 until the tab 72 and 80 are no longer engaging the upper receiver.

As illustrated, an upper receiver with an integral hand guard is provided wherein modular rails 20 can be discreetly located in various positions on the upper receiver. Thus, the user can locate peripheral devices in particular locations suitable for an individual by merely locating the modular rail in an appropriate location. Moreover and should the user desired to swap out the accessory with a larger or smaller accessory, the modular rail may be removed and replaced with a different size modular rail or alternatively the location of the modular rail may be varied.

Still further and by providing this modularity a user can also configure the modular rails 20 to be separated by gaps 84 that can be appropriately located for fingers of a user. Accordingly, operator's fingers will not directly contact the ridges of the rails since they will be able to place their fingers within the gaps 84. Still further, and when no rails are provided vertical channels 26 may also provide a similar function or area for receipt of a user's fingers. Accordingly, gaps 84 and/or channels 26 provide locations for an operator's fingers which prevents them from contacting the features or rails of modular rails 20, which may cause abrasions or cuts. Moreover and in the event the operator is wearing protective gloves, wear and tear on the gloves is also mitigated by locating the operator's fingers in between the modular rails 20.

Figure 19:
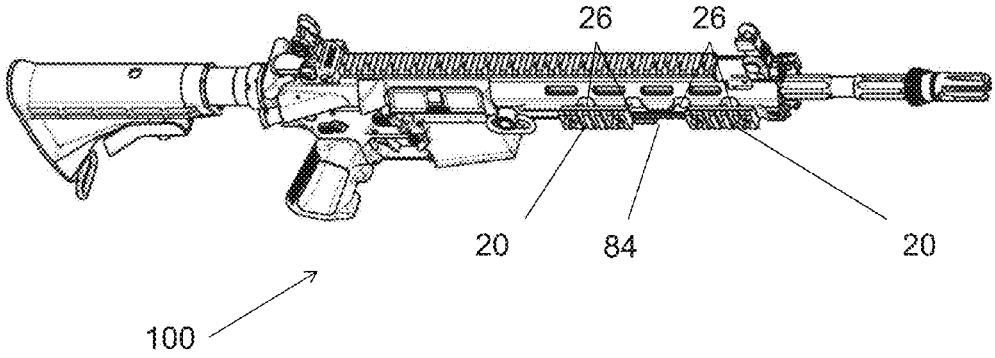
FIG. 19 is view of a firearm with the modular rail system in accordance with an exemplary embodiment of the present invention.

FIG. 19 illustrates a firearm or weapon 100 with the modular rail system 10 in accordance with one non-limiting exemplary embodiment of the present invention.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. An upper receiver for a weapon, the upper receiver comprising: a plurality channels located on top of an exterior surface of the upper receiver each of the plurality of channels being oriented in a first direction and wherein each of the plurality of channels intersect an elongated channel extending in a second direction, wherein the elongated channel is also located on top of the exterior surface of the upper receiver and between at least one flange of an upper ledge portion integrally formed in the exterior surface of the upper receiver and at least one flange of a lower ledge portion integrally formed in the exterior surface of the upper receiver;

a modular rail having a pair of securement features configured to be slidably received within a pair of the plurality of channels such that modular rail can slide in the pair of the plurality of channels in the first direction until the pair of features can slide within the elongated channel in the second direction, wherein the pair of securement features are retained within the elongated channel by having a portion located behind the at least one flange of the upper ledge portion and in front of a surface of the elongated channel and by having another portion located behind a portion of the at least one flange of the lower ledge portion and in front of the surface of the elongated channel such that the pair of securement features cannot be removed from the elongated channel unless they are aligned with a pair of the plurality of channels such that the pair of securement features are no longer located behind the at least one flange of the upper ledge portion and the at least one flange of the lower ledge portion, wherein the plurality of channels and the elongated channel are formed in a hand guard that is integrally formed with the upper receiver.

2. The upper receiver as in claim 1, wherein the first direction is perpendicular to the second direction.

3. The upper receiver as in claim 1, wherein each of the pair of features further comprises a means for fixedly securing the modular rail to the upper receiver.

4. The upper receiver as in claim 1, wherein each of the pair of features engages the at least one flange of the upper ledge portion and the at least one flange of the lower edge portion defining the elongated channel when the modular rail is secured to the upper receiver.

5. The upper receiver as in claim 4, wherein each of the pair of features further comprises a means for fixedly securing the modular rail to the upper receiver and wherein the means further comprises a screw wherein a distal end of the screw is received within an opening in hand guard of the upper receiver when the modular rail is secured to the upper receiver.

6. The upper receiver as in claim 1 in combination with a weapon, wherein the weapon is an automatic or semi-automatic firearm.

7. An upper receiver for a weapon, the upper receiver comprising: a plurality channels each being oriented in a first direction on opposite exterior sides of the upper receiver and wherein each of the plurality of channels intersect an elongated channel extending in a second direction, wherein the plurality of channels and the elongated channel are formed in a hand guard that is integrally formed with the upper receiver, wherein the plurality of channels and the elongated channel are located on top of an exterior surface of the hand guard and between at least one flange of an upper ledge portion integrally formed in the exterior surface of the hand guard and at least one flange of a lower ledge portion integrally formed in the exterior surface of the hand guard;

a plurality of modular rails each having a pair of securement features configured to be slidably received within a pair of the plurality of channels such that each of the plurality of modular rails can slide in the pair of the plurality of channels in the first direction until the pair of features can slide within the elongated channel in the second direction, wherein the pair of securement features are retained within the elongated channel by having a portion located behind the at least one flange of the upper ledge portion and in front of a surface of the elongated channel and by having another portion located behind a portion of the at least one flange of the lower ledge portion and in front of the surface of the elongated channel such that the pair of securement features cannot be removed from the elongated channel unless they are aligned with a pair of the plurality of channels such that the pair of securement features are no longer located behind the at least one flange of the upper ledge portion and the at least one flange of the lower ledge portion.

8. The upper receiver as in claim 7, further comprising a removable bottom portion, wherein the removable bottom portion has an integral rail.

9. The upper receiver as in claim 7, further comprising a removable bottom portion, wherein the removable bottom portion has a plurality channels each being oriented in a first direction and wherein each of the plurality of channels intersect an elongated channel extending in a second direction; and wherein each having a pair of securement features is configured to be slidably received within a pair of the plurality of channels of the removably bottom portion such that each of the plurality of modular rails can slide in the pair of the plurality of channels of the bottom portion in the first direction until the pair of features can slide within the elongated channel in the second direction.

10. The upper receiver as in claim 7, wherein the first direction is perpendicular to the second direction.

11. The upper receiver as in claim 7, wherein each of the pair of features further comprises a means for fixedly securing the modular rail to the upper receiver.

12. The upper receiver as in claim 7, wherein each of the pair of features engages the at least one flange of the upper ledge portion and the at least one flange of the lower edge portion defining the elongated channel when the modular rail is secured to the upper receiver.

13. The upper receiver as in claim 12, wherein each of the pair of features further comprises a means for fixedly securing the modular rail to the upper receiver and wherein the means further comprises a screw wherein a distal end of the screw is received within an opening in the hand guard of the upper receiver when the modular rail is secured to the upper receiver.

14. The upper receiver as in claim 7 in combination with a weapon, wherein the weapon is an automatic or semi-automatic firearm.

15. The upper receiver as in claim 1, wherein the elongated channel is located between a plurality of flanges, which define the upper ledge portion and the at least one flange of the lower edge portion, and wherein each one of the plurality of channels are located between a pair of the plurality of flanges which define the upper ledge portion.

16. The upper receiver as in claim 7, wherein the elongated channel is located between a plurality of flanges, which define the upper ledge portion and the at least one flange of the lower edge portion, and wherein each one of the plurality of channels are located between a pair of the plurality of flanges which define the upper ledge portion.

17. The upper receiver as in claim 15, wherein the plurality of channels, the elongated channel, the plurality of flanges, which define the upper ledge portion and the at least one flange of the lower edge portion are all formed on an integral one piece member of unitary construction.

18. The upper receiver as in claim 16, wherein the plurality of channels, the elongated channel, the plurality of flanges, which define the upper ledge portion and the at least one flange of the lower edge portion are all formed on an integral one piece member of unitary construction.

* * * * *